US005639028A

United States Patent [19]

Kotlyar

[11] Patent Number: 5,639,028

[45] Date of Patent: Jun. 17, 1997

[54] NOZZLE FOR GENERATING AND PROJECTING A DIRECTED STREAM OF LIQUID DROPS

[75] Inventor: Ilya M. Kotlyar, Brooklyn, N.Y.

[73] Assignee: Uniwave, Inc., Farmingdale, N.Y.

[21] Appl. No.: 477,684

[22] Filed: Jul. 3, 1995

[51] Int. Cl.[6] ..... B05B 1/34

[52] U.S. Cl. ..... 239/474; 239/488; 239/590.5

[58] Field of Search ..... 239/487, 488, 239/552.5, 590.5, 590, 104, 8, 423, 424.5, 474; 55/456, 457; 184/6.15, 50.2, 55.1, 55.2

[56] References Cited

U.S. PATENT DOCUMENTS

| | | | |
|---|---|---|---|
| 551,875 | 12/1895 | Schutte . | |
| 654,891 | 7/1900 | Haley | 239/590.5 |
| 1,449,949 | 12/1923 | McDole . | |
| 1,713,357 | 5/1929 | St. Clair . | |
| 2,072,281 | 3/1937 | Simonin | 299/114 |
| 2,089,673 | 8/1937 | Steinmann | 299/140 |
| 2,329,711 | 9/1943 | Gilsenan | 299/112 |
| 3,056,557 | 10/1962 | Walberg | 239/15 |
| 3,062,456 | 11/1962 | Thompson et al. | 239/590.5 |
| 3,726,482 | 4/1973 | Heinrichs | 239/467 |
| 3,941,210 | 3/1976 | Saretzky | 55/91 X |
| 4,350,105 | 9/1982 | Albrecht et al. | 112/256 |
| 4,479,773 | 10/1984 | Tamai | 431/9 |
| 5,152,463 | 10/1992 | Mao et al. | 239/402 |

FOREIGN PATENT DOCUMENTS

| | | | |
|---|---|---|---|
| 619916 | 4/1927 | France . | |
| 228958 | 10/1985 | German Dem. Rep. | B05B 1/34 |
| 2356229 | 5/1975 | Germany | 313/239 |
| 799827 | 1/1981 | U.S.S.R. | B05B 1/30 |
| 1808392 | 4/1993 | U.S.S.R. | B05B 1/34 |
| 143231 | 2/1921 | United Kingdom | 239/488 |
| 9406567 | 3/1994 | WIPO | B05B 1/34 |

*Primary Examiner*—Kevin Weldon

*Attorney, Agent, or Firm*—Schweitzer Cornman Gross & Bondell LLP

[57] ABSTRACT

A nozzle particularly adapted for use in connection with mist oil lubricating units removes the mist oil from the carrier gas, collects the removed oil, and reintroduces it into the interior of the carrier gas flow such that it may be carried in the form of a series of uniformly sized drops to a target to be lubricated. The nozzle may include a helical flow path for the mist, during the traverse of which the mist oil is extracted from the unit, and a needle-like assembly which collects extracted oil and channels it into the interior of the gas flow as it exits the nozzle.

34 Claims, 5 Drawing Sheets

NOZZLE FOR GENERATING AND PROJECTING A DIRECTED STREAM OF LIQUID DROPS

The present invention relates to a new and improved nozzle designed to provide an output in the form of discrete liquid droplets. The nozzle has particular application in conjunction with aerosol lubrication systems where it is desired to direct a focused stream of lubricant towards a device to be lubricated.

BACKGROUND OF THE INVENTION

In the textile arts, as in other industries, there are often needs to provide lubrication to a particular location in a knitting machine, loom or other apparatus. This is often accomplished by generating a mist of lubricant, which is directed towards the targeted area. Because the size of the lubricant droplets suspended in the carrier gas is typically of extremely small diameter, the stream is difficult to direct with accuracy, and is subject to disturbing air currents, resulting in the lubricant not being deposited on the part to be lubricated in sufficient quantities, but rather passing onto adjacent surfaces or remaining in the surrounding air in the form of stray fog.

In addition, however, the provided aerosol is subject to collecting into droplets or masses of various sizes within the delivery tubes. An effective delivery system must also be capable of handling such collected lubricant, metering it properly, without overloading or dripping.

It is accordingly a purpose of the present invention to provide a nozzle capable of providing a spray output of consistently sized drops which may be accurately directed.

Another purpose of the present invention to provide a nozzle adapted to provide a controlled coalescing of liquid particles from an aerosol, such as a lubricant fog, to produce a spray output of consistently sized drops which may be accurately directed to a part to be lubricated.

Another purpose of the present invention is to provide a nozzle in which dripping from the nozzle is substantially eliminated.

Still another purpose of the present invention is to provide a nozzle particularly adapted for use with reduced air flow oil lubrication systems, which may be of the aerosol type.

Yet a further purpose of the present invention is to provide a nozzle of the aforementioned type which is of simple and economical construction, quiet in operation, and which provides minimal interference with the output of a mist oil lubricating system.

BRIEF DESCRIPTION ON THE INVENTION

In accordance with the above and other objects and purposes, a nozzle in accordance with the present invention for use in conjunction with a supplied liquid, which may be suspended in a gas carrier, provides a beam or jet of drops of liquid which may be easily and precisely directed at a target. The nozzle comprises a tubular housing in which is mounted means for collecting the liquid delivered to a first end of the nozzle and channeling it into the interior of a stream of the carrier gas exiting from a second end of the nozzle, whereby the liquid is metered into drops of a relatively consistent size which drops are carried from the nozzle by the carrier gas to the target. When the liquid is applied to the nozzle in the form of an aerosol, the collecting means may be preceded by means for extracting the liquid from the aerosol carrier gas. The means for separating the liquid from the carrier may be a porous felt-like material, a fine mesh, an electrostatic precipitator, or a circuitous or helical path formed within the nozzle body, causing the liquid to collect upon an inner surface of the nozzle body. The collected liquid is delivered into the center of the carrier gas flow exiting from the nozzle by a needle-like structure. The liquid forms an enlarging drop on the needle, and is swept off the needle by the carrier gas and directed to the target when the drop reaches a critical size. A subsequent drop forms, which is similarly swept from the needle, the process repeating so long as the carrier and liquid is applied to the nozzle, creating a continuing sequence of drops which can be accurately directed at a target.

BRIEF DESCRIPTION OF THE DRAWINGS

A fuller understanding of the present invention may be obtained upon consideration of the following detailed description of preferred, but nonetheless illustrative embodiments thereof, when taken in conjunction with the annexed drawings, wherein.

DETAILED DESCRIPTION OF THE INVENTION

Figure 1:
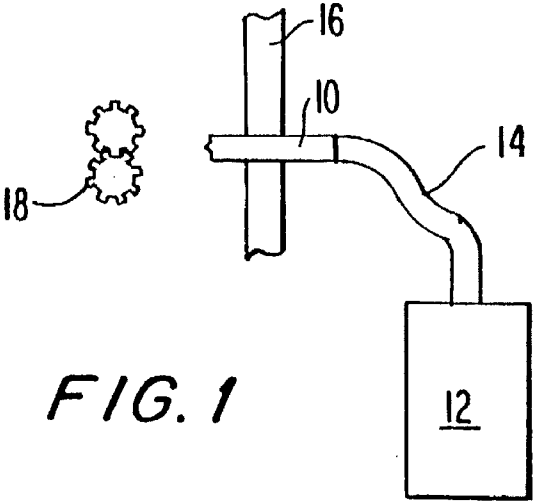
FIG. 1 is a schematic presentation of the present invention incorporated into a mist lubrication system.

With initial reference to FIG. 1, a nozzle 10 according to the present invention may be connected as part of an oil mist lubrication system. As depicted therein, such a system typically includes an oil mist source 12 connected to the nozzle 10 by means of a flexible mist transporting tube 14. It is a particular advantage of a preferred embodiment of the present invention that the nozzle 10 may be formed as a part of the transport tube 14 or, alternatively, may constitute a separate element, coupled thereto by fittings as known in the art. The nozzle 10 is mounted on an appropriate support structure 16, positioned to direct its oil drop output towards a portion of a machine to be lubricated, as illustrated by the mechanism 18.

The mist source 12, as known in the art, produces an air-based aerosol in which oil particles are suspended in the form of droplets typically between 1 and 5 micron in diameter. The aerosol mist is transported through the tube at a velocity range of about 14 to 22 meters per second. If such a mist were to be directly directed to the mechanism 18 the droplets would remain in air suspension, forming a diffuse mist unsuitable for localized point lubrication. The present invention converts such a mist into a coherent series of larger drops which may be effectively and accurately directed at the localized points of the mechanism to be lubricated, and which do not form in an irregular manner which would otherwise result in dripping or misdirection of the lubricant stream. In addition, because the mist may partially agglutinate into drops or a film within the transport tube 14, the present invention also converts such delivered lubricant into the series of drops of consistent size. Both phases of the lubricant may be present; the present invention allows both phases to be collected and delivered as a coherent drop series.

Figure 2:
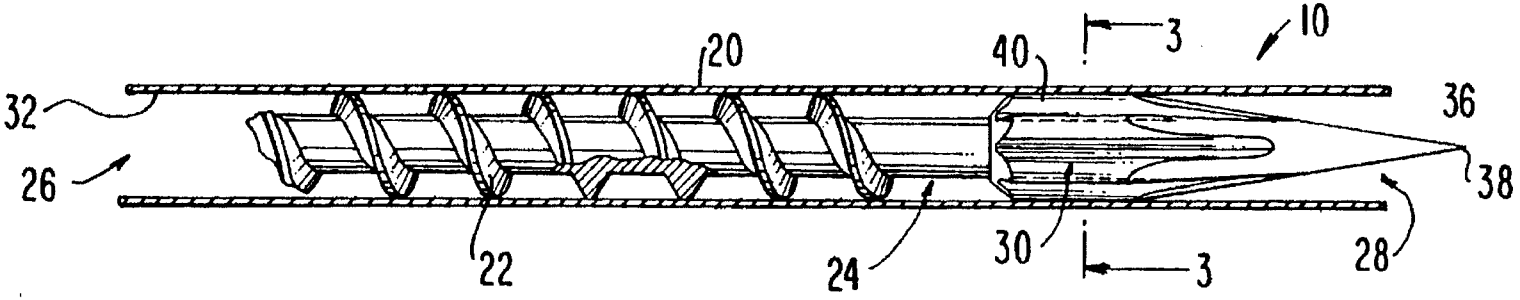
FIG. 2 is an elevation sectional view of a first embodiment of the invention.
Figure 3:
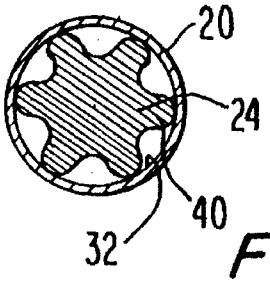
FIG. 3 is a section view taken along line 3—3 of FIG. 2.

As shown in FIGS. 2 and 3, the nozzle 10 may consist of an outer tube or sleeve 20, preferably of circular cross-section, forming a nozzle housing. It is contemplated that the tube may be of a plastic material, such as PTFE or another fluropolymer. A typical inner diameter for the sleeve is about 0.09 inches. The tube may be rigid or flexible, and thus may be straight or curved along its length. The sleeve has an entrance 26 at a first end, which is coupled to the mist source, and an exit 28 at the other end. Supported within the sleeve is a central nozzle core 24, which may be formed of an appropriate structural material, such as brass.

The nozzle core 24 supports an element for separating suspended oil from the carrier air and an element for collecting both the thus-separated oil, as well as oil entering the nozzle in large drops or as a surface film, and channeling all such oil to the interior of the carrier gas stream exiting from the nozzle through exit 28. The core may thus include a first portion positioned proximate the entrance 26 upon which is mounted a helix 22, and a second portion proximate the exit 28 supporting a needle-like assembly 30. The overall length of the core 24 is on the order of 1.2 inches, the helix portion being approximately 0.65 inches long and the needle-like assembly being on the order of 0.42 inches long.

As may be seen, the helix 22 comprises a plurality of thread turns about the core, with a preferred pitch of about 12 tpi. It need not be of constant pitch, however. The threads of the helix engage the inner wall 32 of the sleeve member 20, forming a circuitous passageway along the helix between the inner wall and the core for the oil and carrier gas supplied to the nozzle through the entrance 26.

The helix serves as a means for separating oil particles in the supplied oil mist stream from the carrier air flow. The discharge of the mist on the thread of the helix imparts a rotational velocity to the mist and an angular momentum to the oil particles, developing a radial velocity component which directs them radially outwardly during their travel about the helix and into contact with the inner sleeve wall 32. The rotational velocity imparted to the input stream also causes any of the oil which may have previously coalesced from the mist in the transport tube to travel along the inner wall of the sleeve about the helix. The mist droplets coalesce together and combine with the previously coalesced oil, the combined flow moving along the inner sleeve wall about the passageway defined by the helix as a result of the continuing mist air flow being applied to the nozzle. As the mist air continues its circuitous route, a greater proportion of the remaining suspended lubricant is removed therefrom. It has been found that, with a helix of approximately 6 turns, virtually all of the lubricant is removed from the mist stream during its passage through the helix.

The oil remains on the inner sleeve wall 32 beyond the termination of the helix. It continues to migrate therealong under the influence of the carrier air flow until it reaches the needle-shaped assembly 30, which collects the oil and channels it into the interior of the now essentially oil-free exiting airflow. As may be best seen in FIG. 3, the needle-like assembly may include a plurality of flutes 40 extending out from the core 24. The flutes may be six in number, evenly spaced about the circumference of the central stem, with curved edges, which are in contact with the inner wall of the sleeve. The flutes taper to a conical portion 36 terminating in point 38. The conical portion and point extend beyond the exit 28 of the sleeve.

As the oil propelled in a helical manner reaches the flutes angled to its path, it spreads over the surface of the flutes and continues to be driven forward along the flutes by the carrier gas. The material of the needle-like assembly is chosen to have surface tension properties more favorable to the oil than the inner wall of the sleeve, and thus the oil forms a film, and remains on the flutes, as they taper inwardly and away from the sleeve inner wall. When the core 24 is of brass, the needle-like assembly, as well as the helix, may be of the same material. The needle-like assembly may be solid or be of a sintered porous structure to assist in attracting the oil from the sleeve inner wall. The oil is thus transferred from the sleeve towards the interior of the nozzle by the flutes. As the flute surfaces merge into the conical surface 36 the oil film travels to the needle point 38. There it collects, forming a droplet of growing diameter, until the force exerted upon the droplet by the carrier air exiting from the nozzle is sufficient to remove it from the point, carrying the droplet with the carrier air flow until it impinges upon the target to be lubricated.

Flowing as a thin laminar annular sheet, the carrier gas envelops the forming droplet, and as a result of the velocity and thus pressure gradient existing in the middle of the stream, the flowing carrier tends to entrain the surrounding ambient air into its stream, thus focusing the airflow into a narrow beam with significant thrust. This increases the operational distance from the nozzle exit to the target by an order of 10 over conventional nozzles of the same exit diameter. It also reduces the amount of carrier gas flow required to form and propel the oil droplets. The continuing influence of the carrier flow promotes the continuing development of the droplets and their migration towards the needle point, where they are carried off when they reach the critical size. With a constant carrier air flow the drops are of consistent size.

Figure 4:
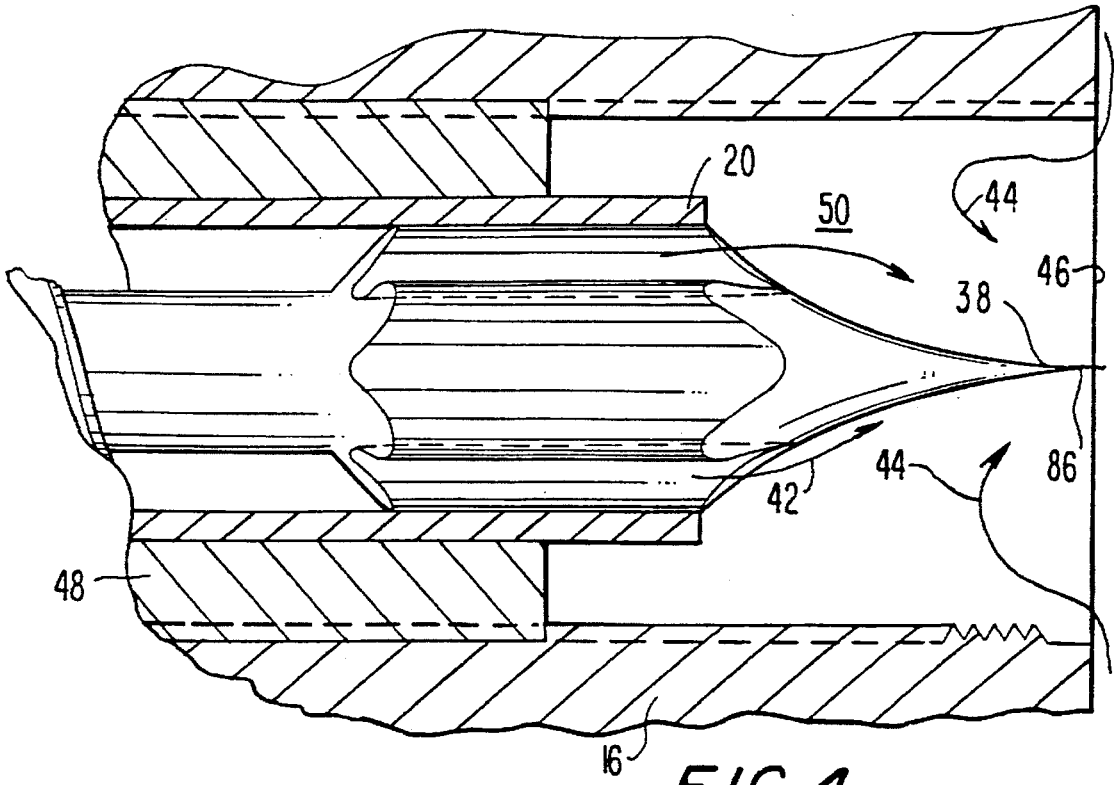
FIG. 4 is an enlarged elevation view of a portion of an alternate embodiment of the invention, mounted in a bore, depicting an alternative needle configuration.

As shown in FIG. 4, the needle-like assembly may include a conical portion 42 of concave profile, conjugated with the carrier gas flow channels formed by the flutes to form a smooth transition from the flute portion. The radius of curvature may be on the order of 0.19 inches, with an included angle of the point 38 of about 18 degrees. Such a configuration may allow for better entrainment of surrounding air 44 into the exiting air flow when the nozzle is placed flush or below the surface 46 of the support structure 16, typically in a mounting sleeve 48 threaded into a counterbore or mounting hole 50. The Figure further shows the needle tip terminating in an extended flexible fiber 86, along which the drops travel prior to release into the exiting air flow. The fiber may be of the same material as the main portion of the assembly, or may be of another material as appropriate. It is contemplated that the use of polypropylene for the needle-like assembly may allow the fiber 86 to be drawn from the needle tip.

Figure 5:
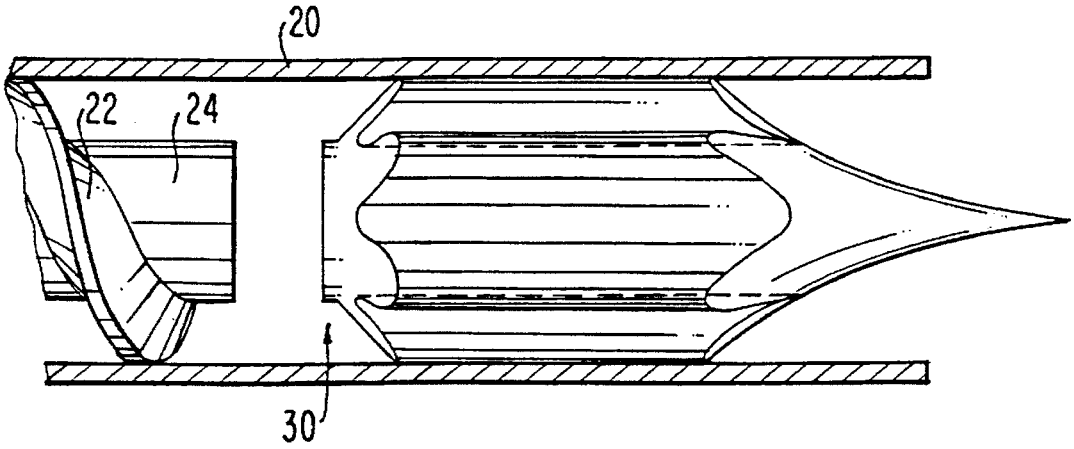
FIG. 5 is an elevation view of an alternative embodiment in which the helix and needle-like elements are independently located within the nozzle.

Various other alternative embodiments for the present invention are contemplated, each of said embodiments comprising means for separating the liquid, such as oil from the aerosol and second means for directing the separated liquid into the interior of the exit air stream for formation into a sequence of droplets which are to be carried by the airstream to the target. Thus, in the embodiment set forth in FIG. 5, the helix 22 which separates the liquid from the airstream forms a member separate and apart from the needle-shaped assembly 30. Each may be individually positioned in the sleeve 20. In accordance with the invention, the needle-shaped assembly can be utilized separate and apart from the helix member.

Figure 6:
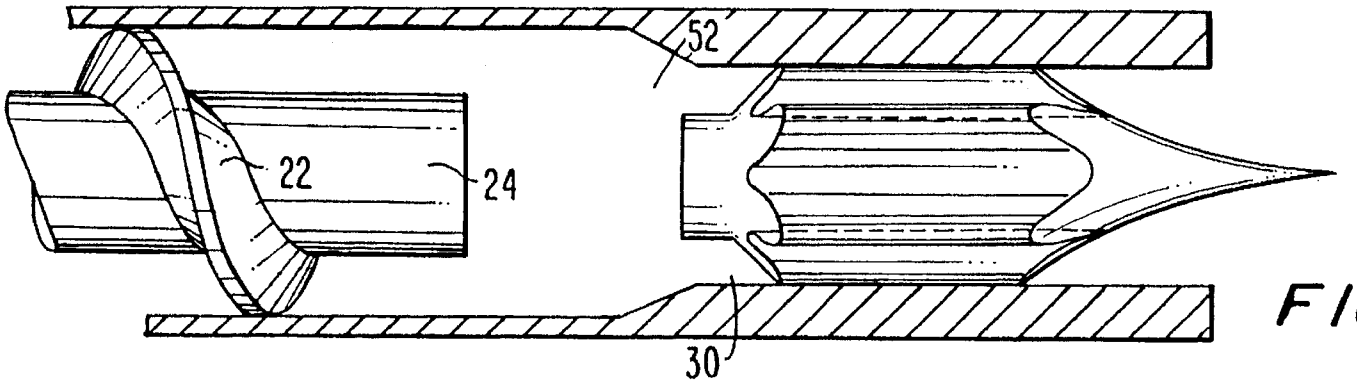
FIG. 6 is a detailed elevation view of an alternative embodiment in which the nozzle sleeve is of lesser inner diameter about the needle-like element than about the helix.
Figure 7:
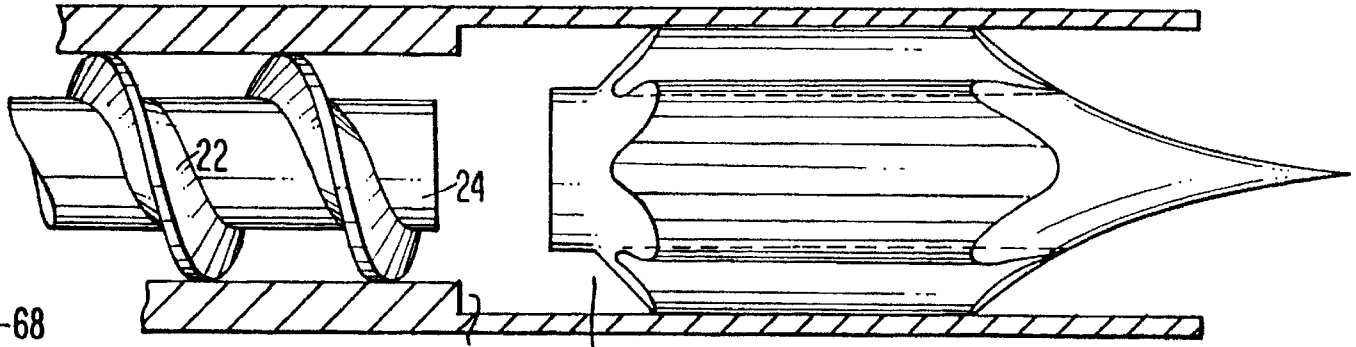
FIG. 7 is a detailed elevation view of an alternative embodiment in which the nozzle sleeve is of greater inner diameter about the needle-like element than about the helix.

As further shown in FIGS. 6 and 7, other embodiments for the invention contemplate that the inner diameter of the sleeve portion in which the helix is located differs from the inner diameter of the sleeve portion in which the flute assembly is mounted. In FIG. 6 the helix diameter is greater than the flute diameter; a transition region 52 is provided between the respective sleeve portions. In FIG. 7 the helix diameter is less than the flute diameter; a step 54 accommodates the different sleeve diameters.

Figure 8:
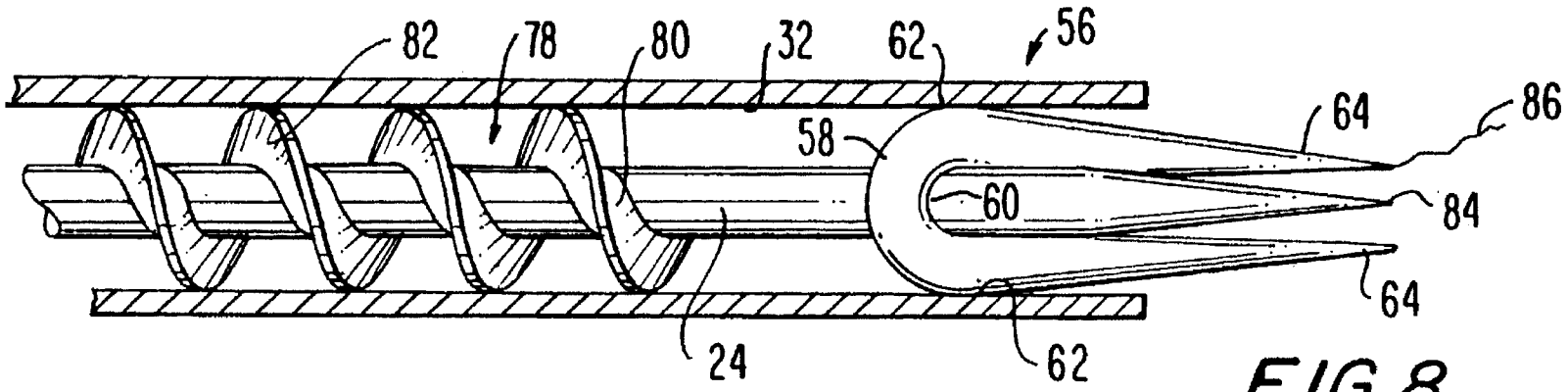
FIG. 8 is a detailed elevation view of an alternative embodiment in which the needle-like element has multiple points.

While the liquid-removing helix is shown in the forgoing figures as having a single lead, it may also be formed with multiple leads and with multiple ends to the needle-like assembly. Such a multiple lead, multiple end embodiment is presented in FIG. 8. As shown therein, the twin helix 78 is formed from a pair of leads. In addition, the needle-like assembly 56 is formed by a wire 58 wrapped about the end of the core 24. The wire is mounted to the core at point 60 and engages the inner wall 32 of the sleeve at points 62, allowing liquid transfer from the sleeve wall to the needle-like assembly to occur. The ends of the wires are positioned within the interior of the exiting carrier flow, and are pointed into tips 64. The end of the core 24 is similarly tapered to a point 84, and offset from the center of the flow to define a generally triangularly arranged triple tip arrangement. Such multiple points may be used to generate larger size drops than a single point, the drop being formed between the points, and may incorporate fibers 86, only one of which is shown, extending from the needle tips.

Figure 9:
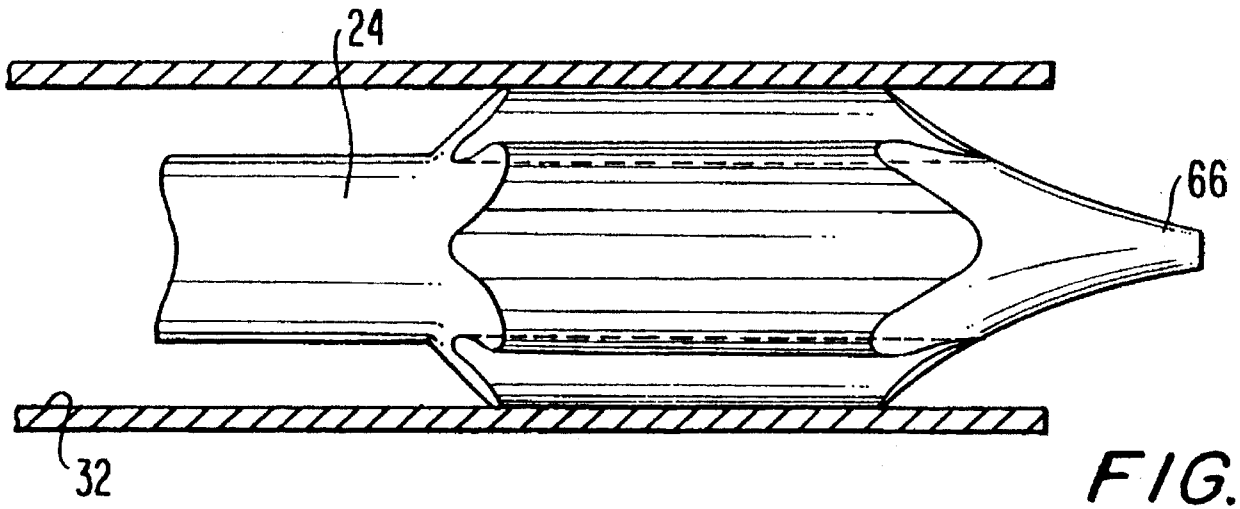
FIG. 9 is an elevation view of an alternative embodiment in which the needle-like element is tapered to a flattened point.

As shown in FIG. 9, the needle point may alternatively be of other than a true point. In FIG. 9 it is presented in the form of a vertically-oriented wedge 66. The shape of the point may be used to control the size of the drops formed.

Figure 10:
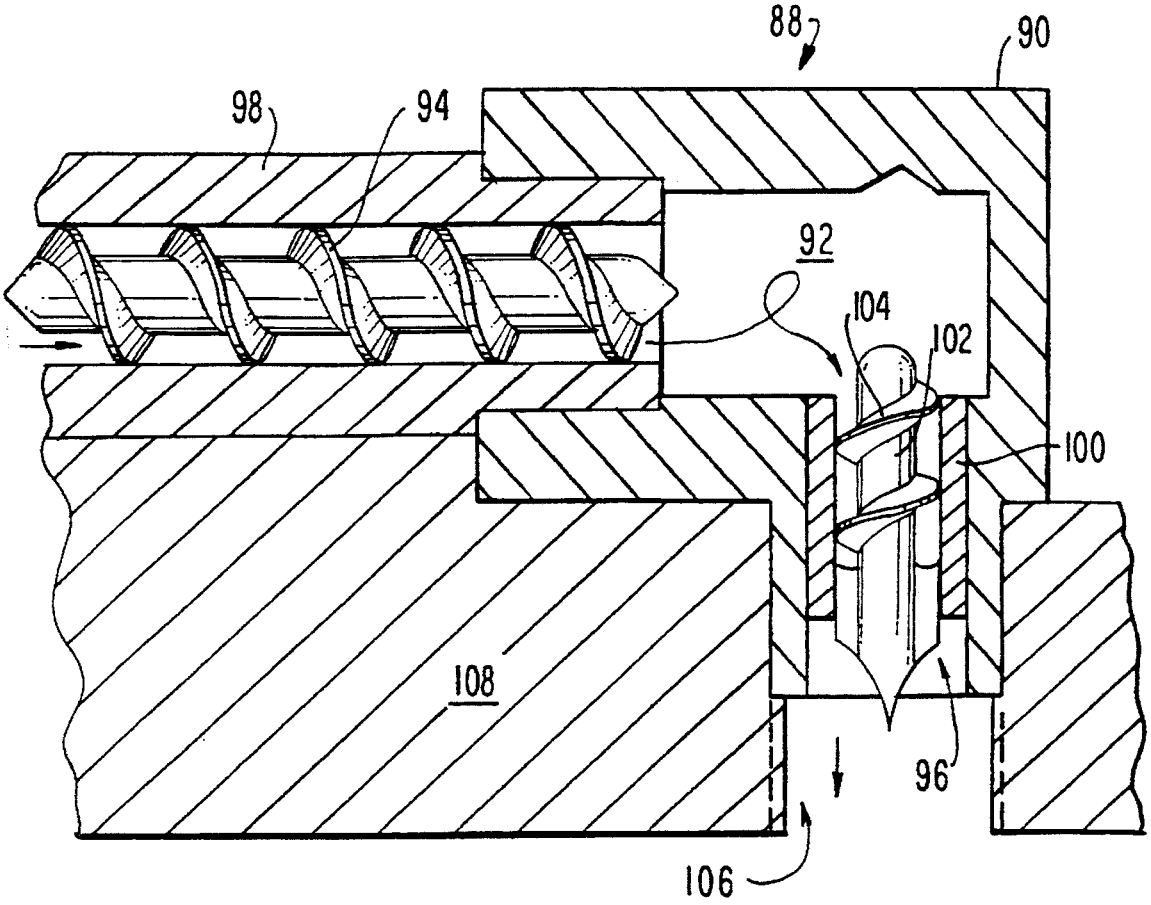
FIG. 10 is an elevation view of an alternative embodiment in which the nozzle is of an angular construction.

FIG. 10 depicts an embodiment of the invention in which the nozzle is formed with a right-angle bend. Such a construction is of applicability when the nozzle is to be mounted in a confined space. As shown, the nozzle sleeve in which the helix and needle-like assembly are mounted is divided into rear sleeve 98, which may comprise a portion of the mist transport tube, and forward sleeve 100. The two sleeve portions are interconnected by elbow 90 having internal right-angle passageway 92 which joins the sleeve passageways together. While the elbow 90 is shown as a 90 degree coupling, it is to be recognized that it may be constructed with any appropriate angle between the sleeve portions.

Helix 94 is mounted in rear sleeve 98, while needle-like assembly 96 is mounted in the forward sleeve 100. Nozzle core portion 102, from which the needle-like assembly extends, may support an auxiliary helix 104, which further assists in removing the oil mist from the carrier gas, and which can provide additional support for the needle-like assembly within the sleeve. The sleeve 100 may be provided with an exterior thread 104, which allows the nozzle assembly to be mounted in the bore 106 in support structure 108. The elbow 90 is constructed of an appropriate material, such as PTFE, to maintain the flow of oil along its inner surface between the sleeve portions.

Figure 11:
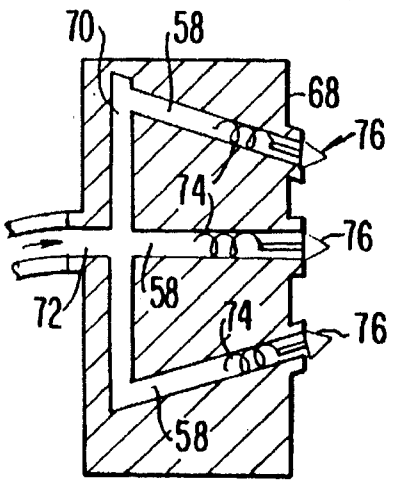
FIG. 11 presents a multiple nozzle embodiment.

As shown in FIG. 11, it is further contemplated that a plurality of nozzles of the present invention may be coupled to a single mist source to allow a contoured surface to be lubricated. As shown therein, multiple nozzle body 68 includes a plurality of passageways 70 coupled to a common inlet 72. The major axis of each of the passageways is chosen in accordance with the relative positioning of the surface or element to be lubricated. A helix 74 and a needle-shaped assembly 76, formed either as a unitary member or as discrete elements, are mounted in each of the passageways, resulting in multiple lubricant jets being directed at the target.

It is to be recognized that other embodiments and adaptations of the invention are possible without departing from the intended scope of the invention.

I claim:

1. A nozzle, comprising a housing having an inlet for an aerosol comprising a liquid dispersed through a carrier gas flow and an exit; means coupled to said inlet for extracting the liquid from said carrier gas and collecting said liquid; and means for reintroducing said collected liquid into an interior of the carrier gas flow in a manner whereby discrete drops of said liquid are formed and are carried by the gas flow from said exit.

2. The nozzle of claim 1, wherein said liquid extracting and collecting means comprise a helical flow passageway within said housing.

3. The nozzle of claim 1, wherein said means for reintroducing said collected liquid comprises a needle-like assembly.

4. The nozzle of claim 2, wherein said helical flow passageway is formed by a helix mounted within said housing, said passageway being defined by an least one thread of said helix and an inner wall of said housing.

5. The nozzle of claim 4, wherein said housing is cylindrical.

6. The nozzle of claim 4, wherein said inner wall is adapted and constructed to collect said liquid thereon.

7. The nozzle of claim 5, wherein said means for reintroducing said collected liquid comprises a needle-like assembly within said housing having flutes in contact with said inner wall.

8. The nozzle of claim 7, wherein said needle-like assembly comprises a plurality of flutes coupled to a tapering surface.

9. The nozzle of claim 8, wherein said tapering surface terminates at a point.

10. The nozzle of claim 8, wherein said tapering surface terminates in a wedge.

11. The nozzle of claim 8, wherein said needle-like assembly is mounted within said housing with a portion of said conical surface extending beyond said exit.

12. The nozzle of claim 9, wherein said point is centrally located with respect to the gas flow from said exit.

13. The nozzle of claim 8, wherein the flutes are six in number.

14. The nozzle of claim 7, wherein said helix and said needle-like assembly are mounted upon a common core within said housing.

15. The nozzle of claim 7, wherein said helix and said flute assembly are individually positionable within said housing.

16. The nozzle of claim 15 wherein said housing comprises first and second portions joined at an angle, at least a portion of said helix being mounted in said first portion and said needle-like assembly being mounted in said second portion.

17. The nozzle of claim 16 wherein said first and second housing portions are joined at a right angle.

18. A nozzle, comprising a tubular housing having a first end for coupling to an aerosol mist source having a liquid mist in a gas carrier and a second exit end;

at least one helical passageway within a first portion of said housing having a surface for collection in the form of a film of liquid particles removed from the gas carrier as it traverses said helical passageway;

a needle-like assembly located within a second portion of said housing proximate the second end of the housing and downstream of said helical passageway having a flute portion in contact with said collection surface for receipt and collection of the liquid film thereon and a needle portion for reintroducing said liquid film in the form of discrete drops into an exiting flow of the gas carrier from said exit end.

19. The nozzle of claim 18, wherein said needle-like assembly is spaced from said helical passageway.

20. The nozzle of claim 18, wherein said collection surface comprises a portion of an inner wall of said housing.

21. The nozzle of claim 20, wherein said inner wall is of constant diameter between said helix and said flute assembly.

22. The nozzle of claim 20, wherein the portion of the inner wall of the first portion of the housing is of a different diameter than the portion of the inner wall of the second portion of the housing.

23. The nozzle of claim 19 wherein said first and second housing portions are joined at an angle.

24. A nozzle assembly comprising a housing, at least one fluid passageway therein comprising a first end for coupling to an aerosol mist source having a liquid lubricant mist in a gas carrier and a second end for discharge of a lubricant stream towards a selected target; each of said at least one passageways including a circuitous portion thereof having a surface for collecting liquid extracted from said gas carrier on said surface as a film and a flute assembly located proximate the second end of said passageway in contact with said surface for receipt of the liquid film and having a needle portion for reintroducing said liquid film in the form of discrete drops within an exiting flow of the gas carrier from the second end.

25. A nozzle, comprising a housing having an inlet for receipt of a liquid propelled by a carrier gas flow, said housing having means for collecting said liquid into a continuing flow from said inlet to an exit of said housing; and means for introducing said collected liquid into an interior of the carrier gas flow in a manner whereby discrete drops of said liquid are formed and are carried by the gas flow from said exit.

26. The nozzle of claim 25, wherein said means for introducing said collected liquid comprises a needle-like assembly.

27. The nozzle of claim 26, wherein said needle-like assembly is located proximate the exit of the housing and has a flute portion in contact with said collection means for receipt of the liquid and a needle portion for introducing said liquid in the form of discrete drops into an exiting flow of the gas carrier from said exit.

28. The nozzle of claim 27, wherein said collection means comprises a portion of an inner wall of said housing.

29. The nozzle of claim 27, wherein said needle portion comprises at least one tapered surface terminating in a drop-forming tip.

30. The nozzle of claim 29, wherein said tapered surfaces are three in number, said drop-forming tips being arranged in a triangular orientation within the exterior of the carrier gas flow.

31. The nozzle of claim 26, wherein said needle-like assembly comprises a plurality of needle tips.

32. The nozzle of claim 25, wherein said needle-like structure is formed from a porous media.

33. The nozzle of claim 25, wherein said needle-like assembly includes a needle tip and a flexible fiber extending from said tip.

34. The nozzle of claim 31 further comprising a flexible fiber extending from at least one of said needle tips.

* * * * *